US008567498B2

(12) United States Patent
Scott et al.

(10) Patent No.: US 8,567,498 B2
(45) **Date of Patent: *Oct. 29, 2013**

(54) SYSTEM AND METHOD FOR FILTERING SAND IN A WELLBORE

(75) Inventors: Steven W. Scott, Stavanger (NO); Steinar Bakke, Tananger (NO); John Zarnowiecki, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 382 days.

This patent is subject to a terminal disclaimer.

(21) Appl. No.: 12/840,953

(22) Filed: Jul. 21, 2010

(65) Prior Publication Data

US 2011/0180257 A1 Jul. 28, 2011

Related U.S. Application Data

(60) Provisional application No. 61/297,503, filed on Jan. 22, 2010, provisional application No. 61/297,525, filed on Jan. 22, 2010.

(51) Int. Cl.
*E21B 7/08* (2006.01)

(52) U.S. Cl.
USPC ..... 166/278; 166/51; 166/230

(58) Field of Classification Search
USPC ..... 166/227, 228, 230, 231, 232, 233, 234, 166/235, 51, 278
See application file for complete search history.

(56) References Cited

U.S. PATENT DOCUMENTS

| | | | |
|---|---|---|---|
| 4,314,129 | A | 2/1982 | Wilson et al. |
| 5,339,895 | A | 8/1994 | Arterbury et al. |
| 5,355,956 | A | 10/1994 | Restarick |
| 5,404,954 | A | 4/1995 | Whitebay et al. |
| 5,411,084 | A | 5/1995 | Padden |
| 5,509,483 | A | 4/1996 | Graen |
| 5,611,399 | A | 3/1997 | Richard et al. |
| 5,624,560 | A | 4/1997 | Voll et al. |
| 5,642,781 | A | 7/1997 | Richard |
| 5,664,628 | A | 9/1997 | Koehler et al. |
| 5,782,299 | A | 7/1998 | Simone et al. |
| 5,823,260 | A | 10/1998 | McConnell et al. |
| 5,849,188 | A | 12/1998 | Voll et al. |
| 5,899,271 | A | 5/1999 | Simone et al. |

(Continued)

FOREIGN PATENT DOCUMENTS

WO 2009108128 A1 9/2009

OTHER PUBLICATIONS

Baker Hughes, Baker Oil Tools. Excluder2000Screen. Jun. 2005. Houston, Texas, US, pp. 1-4.

(Continued)

*Primary Examiner* — Frederick L Lagman
(74) *Attorney, Agent, or Firm* — David G. Matthews; Brandon Clark; Robert Van Someren

(57) ABSTRACT

A technique enables long-lasting filtering of fluid flow in a wellbore. The technique employs a base pipe and a sand control screen surrounding the base pipe. The sand control screen has a support layer, a filter media surrounding the support layer, and a protective shroud. At least one of the support layer and the protective shroud layer utilizes longitudinal ribs held in place by a transverse wire. The components of the sand control screen cooperate to provide a simple but durable system for long term filtering of sand from fluid flow in a wellbore.

20 Claims, 5 Drawing Sheets

(56) References Cited

U.S. PATENT DOCUMENTS

| | | | | |
|---|---|---|---|---|
| 5,979,551 | A * | 11/1999 | Uban et al. | 166/233 |
| 5,980,745 | A | 11/1999 | Voll et al. | |
| 6,092,604 | A | 7/2000 | Rice et al. | |
| 6,109,349 | A | 8/2000 | Simone et al. | |
| 6,158,507 | A | 12/2000 | Rouse et al. | |
| 6,305,468 | B1 | 10/2001 | Broome et al. | |
| 6,382,318 | B1 | 5/2002 | Whitlock | |
| 6,478,092 | B2 | 11/2002 | Voll et al. | |
| 6,514,408 | B1 | 2/2003 | Simone | |
| 6,516,881 | B2 * | 2/2003 | Hailey, Jr. | 166/233 |
| 6,520,254 | B2 * | 2/2003 | Hurst et al. | 166/235 |
| 6,607,032 | B2 | 8/2003 | Voll et al. | |
| 6,619,401 | B2 | 9/2003 | Echols et al. | |
| 6,715,544 | B2 | 4/2004 | Gillespie et al. | |
| 6,830,104 | B2 * | 12/2004 | Nguyen et al. | 166/235 |
| 7,497,257 | B2 | 3/2009 | Hopkins et al. | |
| 7,578,344 | B2 | 8/2009 | Hopkins et al. | |
| 7,588,079 | B2 | 9/2009 | Kluger et al. | |
| 7,757,401 | B2 | 7/2010 | Richard et al. | |
| 8,176,634 | B2 | 5/2012 | Bonner et al. | |
| 2003/0173075 | A1 * | 9/2003 | Morvant et al. | 166/230 |
| 2004/0134656 | A1 * | 7/2004 | Richards | 166/228 |
| 2005/0086807 | A1 | 4/2005 | Richard et al. | |
| 2006/0137883 | A1 * | 6/2006 | Kluger et al. | 166/230 |
| 2008/0217002 | A1 * | 9/2008 | Simonds et al. | 166/230 |
| 2008/0283239 | A1 | 11/2008 | Langlais et al. | |
| 2008/0289815 | A1 | 11/2008 | Moen et al. | |
| 2009/0078403 | A1 | 3/2009 | Langlais | |
| 2010/0000742 | A1 | 1/2010 | Bonner et al. | |
| 2010/0122810 | A1 | 5/2010 | Langlais | |
| 2010/0258300 | A1 | 10/2010 | Shoemate | |
| 2010/0319914 | A1 | 12/2010 | Dowsett et al. | |
| 2011/0180258 | A1 | 7/2011 | Scott et al. | |

OTHER PUBLICATIONS

Baker Hughes, Baker Oil Tools. Sand Control Screen Technologies. Dec. 2008. Houston, Texas, US, pp. 1-12.

BJ Services Company. DynaFlo DB Well Screens. Jul. 27-29, 2004. pp. 1 and 2.

Halliburton. Sand Control. PoroMax Screens. "Maximizing Performance and Value." Jul. 2005. pp. 1-2.

Halliburton. Sand Control Solutions. PoroPlus Screens. Oct. 2001. pp. 1-2.

Weatherford. Excelflo Screens. Well Screen. Jul. 2004. Houston, Texas. pp. 1-2.

Weatherford. Maxflo Screens. Well Screen. 2005-2006. Houston, Texas. pp. 1-2.

* cited by examiner

SYSTEM AND METHOD FOR FILTERING SAND IN A WELLBORE

CROSS-REFERENCE TO RELATED APPLICATION

The present document is based on and claims priority to U.S. Provisional Application Ser. No. 61/297,503, filed Jan. 22, 2010, and to U.S. Provisional Application Ser. No. 61/297,525, filed Jan. 22, 2010.

BACKGROUND

In many types of wells, inflowing fluid passes through a sand screen which filters out particulates from the inflowing fluid, e.g. oil or other fluid to be produced. The sand screen comprises a tubular filter media having a length significantly greater than its diameter. The tubular filter media often is constructed of a cloth type material, such as a woven wire mesh. However, this type of filter media is susceptible to damage and/or destruction. For example, fluid flow through the filter media creates a pressure difference across the filter media which can become high enough to collapse the filter media onto a base pipe. The collapsed filter media interrupts proper flow of fluid with respect to the sand control screen. A variety of layers are sometimes used in combination with the filter media, but current approaches are insufficient to adequately protect the filter media in a variety of downhole environments.

SUMMARY

In general, the present invention provides a technique for filtering sand from fluid flowing in a wellbore. The technique employs a base pipe and a sand control screen surrounding the base pipe. The sand control screen comprises a support layer, a filter media surrounding the support layer, and a protective shroud. At least one of the support layer and the protective shroud layer utilizes longitudinal ribs held in place by a transverse wire. The components of the sand control screen cooperate to provide a simple but durable system for long term filtering of sand from fluid flow in a wellbore.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

In the following description, numerous details are set forth to provide an understanding of the present invention. However, it will be understood by those of ordinary skill in the art that the present invention may be practiced without these details and that numerous variations or modifications from the described embodiments may be possible.

The present invention generally relates to a system and methodology for filtering sand in a downhole, wellbore environment. The technique utilizes one or more sand control screens positioned along downhole well equipment, e.g. as part of a downhole well completion, to filter sand from well fluid flowing into, or out of, the downhole well completion. Each sand control screen is designed to provide substantial support for a filter media, and thus to prevent collapse or other damage to the filter media.

According to one embodiment, the sand control screen is mounted around an interior base pipe and comprises one or more layers having a plurality of longitudinal ribs deployed along an adjacent layer of the sand control screen. A wire is wrapped transversely about the plurality of longitudinal ribs to secure the plurality of longitudinal ribs with respect to the base pipe. A filter media may be disposed over the transversely wrapped wire and/or within the longitudinal ribs. Additionally, an outer, protective shroud may be employed to protect the interior sand control screen layers. The combination of sand control screen components enables long-term use of the sand screen without collapse.

In some applications, the sand control screen comprises a drainage layer positioned between an outside diameter of the base pipe and an inside diameter of the filter media. The drainage layer may be formed with the plurality of longitudinal ribs laid directly on the base pipe and held securely in place by the wire wrapped transversely around the outside of the longitudinal ribs. The sand control screen also may be constructed with the outer, protective shroud formed with a plurality of longitudinal/axial ribs held in a tubular shaped by a shroud wire wrapped transversely about the outside of the ribs. The shroud ribs may or may not lie directly on an outside diameter of the filter media.

Depending on the particular filtering application, the filter media may be formed of a cloth type material, such as a woven wire mesh. However, the present system and methodology are able to provide substantial support for wire mesh filter media, and for a variety of relatively weak filter media, to facilitate long term flow of fluid across the filter media. According to one embodiment, a tight fit between the longitudinal ribs of the sand control screen and the internal base pipe further improves the strength of the sand screen and prevents deformation and/or collapse of the filter media in the event a pressure differential develops across the filter media due to plugging.

Figure 1:
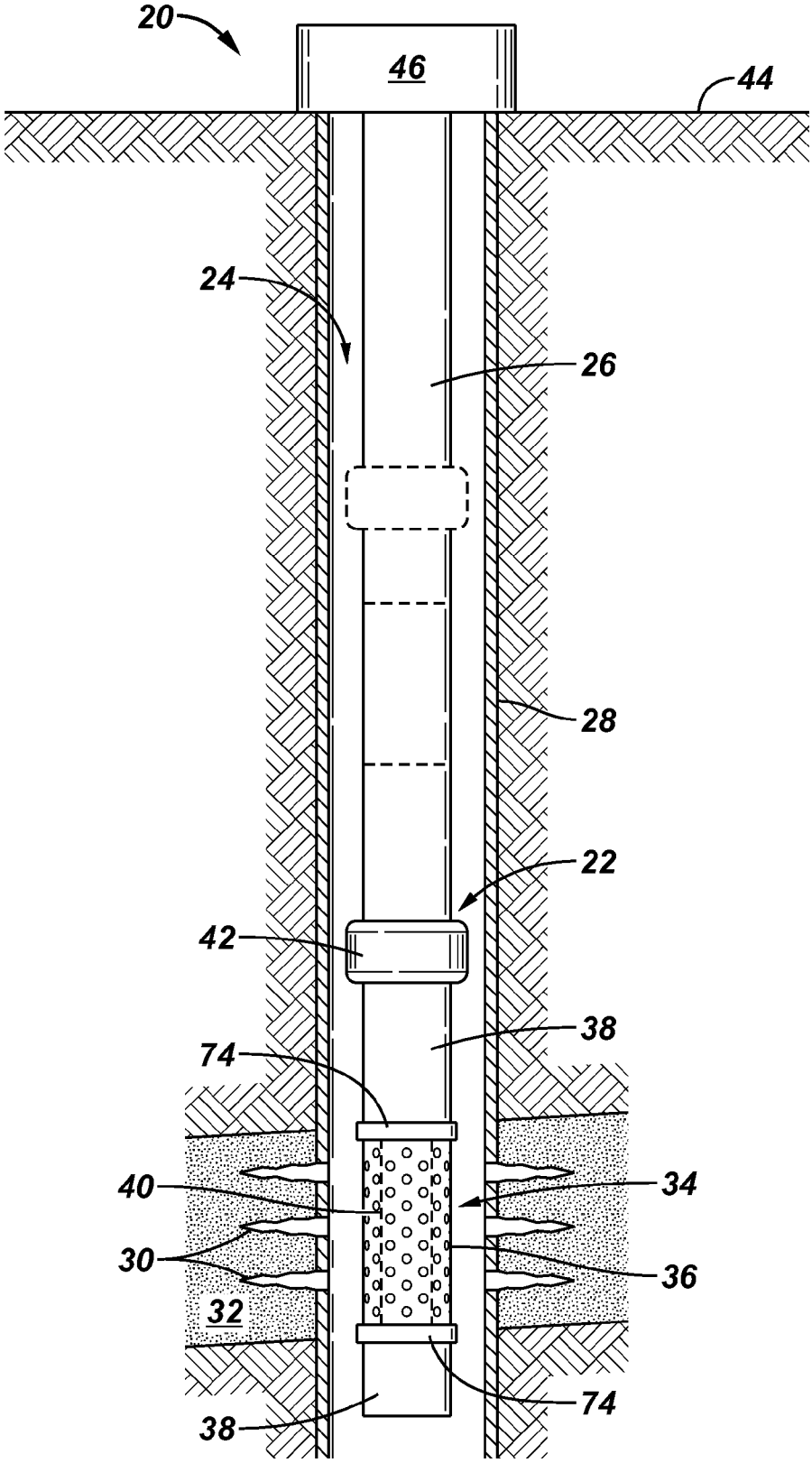
FIG. 1 is a schematic illustration of one example of a sand control screen deployed in a wellbore, according to an embodiment of the present invention.

Referring generally to FIG. 1, one example of a well system 20 for filtering fluids in a downhole environment is illustrated schematically. In this example, well system 20 comprises well equipment 22, e.g. a well completion, deployed downhole into a wellbore 24. The well equipment 22 may be deployed downhole via a conveyance 26, such as coiled tubing, production tubing, or another suitable conveyance.

Depending on the specific application, wellbore 24 may be cased or lined with a casing 28 having perforations 30 to enable fluid communication between a surrounding formation 32 and the wellbore 24.

Well equipment 22 may include many types of devices, components and systems. For example, the well equipment may comprise a variety of artificial lift systems, sensor systems, monitoring systems, and other components designed to facilitate production operations, servicing operations, and/or other well related operations. In the example illustrated, well equipment 22 further comprises a sand control assembly 34.

The sand control assembly 34 comprises a sand control screen 36 designed to filter sand from fluid flowing across the sand control screen. For example, reservoir fluid flowing into wellbore 24 from formation 32 passes through sand control screen 36 which filters out sand while allowing the reservoir fluid passage into well equipment 22. The sand control screen 36 may be used in cooperation with and/or positioned between other components 38 of well equipment 22. Additionally, the sand control assembly 34 may comprise a base pipe 40 positioned such that the sand control screen 36 is mounted over the base pipe 40.

Well equipment 22 also may comprise one or more isolation devices 42, e.g. packers, positioned to enable selective isolation of a specific well zone associated with the sand control assembly 34. It should be noted that well equipment 22 also may comprise additional sand control assemblies 34 (see additional assembly shown in dashed lines) and isolation devices 42 to isolate and control fluid flow from, or into, other well zones.

In FIG. 1, wellbore 24 is illustrated as a generally vertical wellbore extending downwardly from a surface location 44. Additionally, well equipment 22 is illustrated as deployed downhole into the generally vertical wellbore 24 beneath surface equipment 46, such as a wellhead. However, the design of wellbore 24, surface equipment 46, and other components of well system 20 can be adapted to a variety of environments. For example, wellbore 24 may comprise a deviated, e.g. horizontal, wellbore or a multilateral wellbore extending from surface or subsea locations. The well equipment 22 also may be designed for deployment into a variety of vertical and deviated wellbores drilled in a variety of environments.

Figure 2:
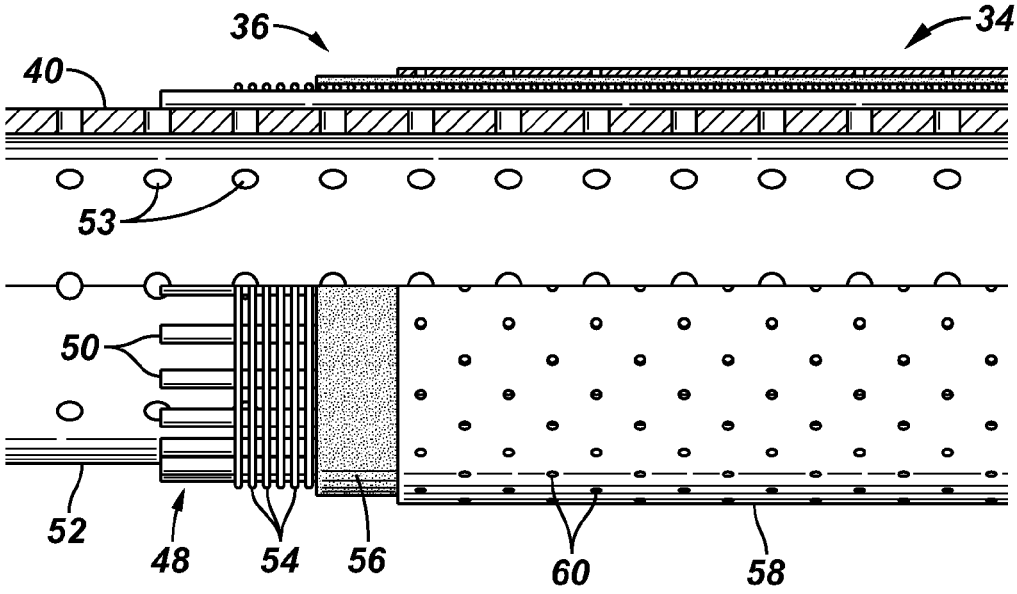
FIG. 2 is a partially broken away view of one example of a sand control screen having a plurality of layers, according to an embodiment of the present invention.

Referring generally to FIG. 2, one embodiment of sand control assembly 34 is illustrated. In this embodiment, sand control screen 36 is mounted over base pipe 40 and has a length dimension substantially greater than its diameter. A filter media support layer 48 also serves as a drainage layer and comprises a plurality of longitudinal ribs 50 which are disposed along a perforated portion 52 of base pipe 40 having openings or perforations 53. The plurality of longitudinal ribs 50 is secured in position around base pipe 40 by a wire 54 which may be wrapped transversely around the plurality of longitudinal ribs 50. In one example, wire 54 is helically wrapped around the longitudinal ribs 50. For example, wire 54 may be wrapped around the longitudinal ribs in a manner that secures the longitudinal ribs directly against an outer surface of the base pipe 40. By securing longitudinal ribs 50 directly against base pipe 40, the sand control screen 36 becomes securely held on base pipe 40 without the need for welding of the sand control screen 36 to the base pipe 40.

A filter media 56 is disposed around the longitudinal ribs 50 of support layer 48. By way of example, the filter media 56 may comprise a cloth material, such as a woven wire cloth, although other types of filter media may be employed. In some embodiments, filter media 56 is deployed directly against wire 54, although one or more standoff layers may be positioned between wire 54 and filter media 56, as discussed in greater detail below. The filter media 56 may be formed into a tubular element sized to fit closely over the outside diameter of the transversely wrapped wire 54.

Additionally, a protective shroud 58 may be disposed around filter media 56 to protect the filter media while still allowing flow of fluid therethrough. In one example, protective shroud 58 is a metal tube having multiple openings/perforations 60 to facilitate inflow, or outflow, of fluid. The outer, protective shroud 58 may be tightly positioned around and against filter media 56, although other embodiments employ one or more standoff layers between the filter media 56 and the protective shroud 58, as discussed in greater detail below. Sometimes, post-assembly processes may be applied to protective shroud 58 to re-size the protective shroud, thereby reducing or eliminating gaps between layers of sand control screen 36.

Figure 3:
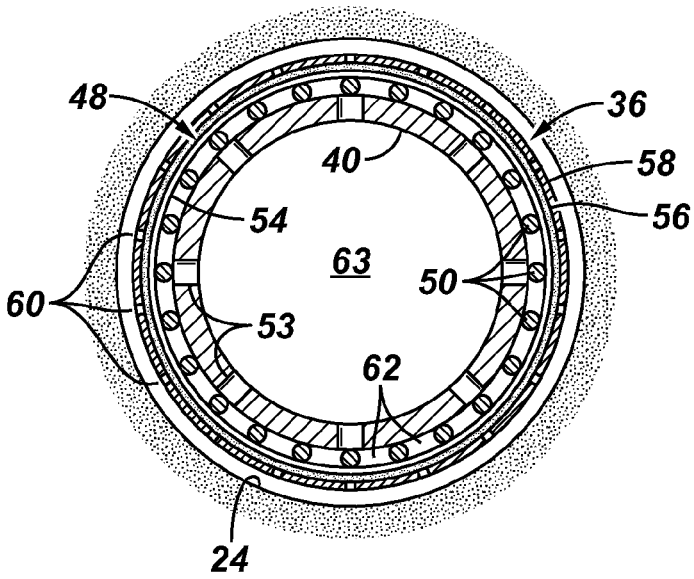
FIG. 3 is a cross-sectional view of one example of a sand screen having axial flow channels, according to an embodiment of the present invention.

Referring generally to FIG. 3, a cross-sectional view of the sand control screen embodiment of FIG. 2 is illustrated. The cross-sectional view shows a plurality of flow channels 62 which are created between longitudinal ribs 50. In the embodiment illustrated, flow channels 62 are oriented generally in an axial direction to enable axial flow of fluid along the space between filter media 56 and base pipe 40. The spacing between adjacent longitudinal ribs 50, as well as the spacing between adjacent wraps of wire 54, is greater than the pore size of the filter media. If, for example, the filter media 56 comprises woven wire, the spaces or pores through the woven wire are selected to restrict particles of smaller size than would be restricted by the spacing between longitudinal ribs 50 or between the wraps of wire 54. FIG. 3 also illustrates an interior 63 of base pipe 40 along which fluids may be produced and/or injected.

Figure 4:
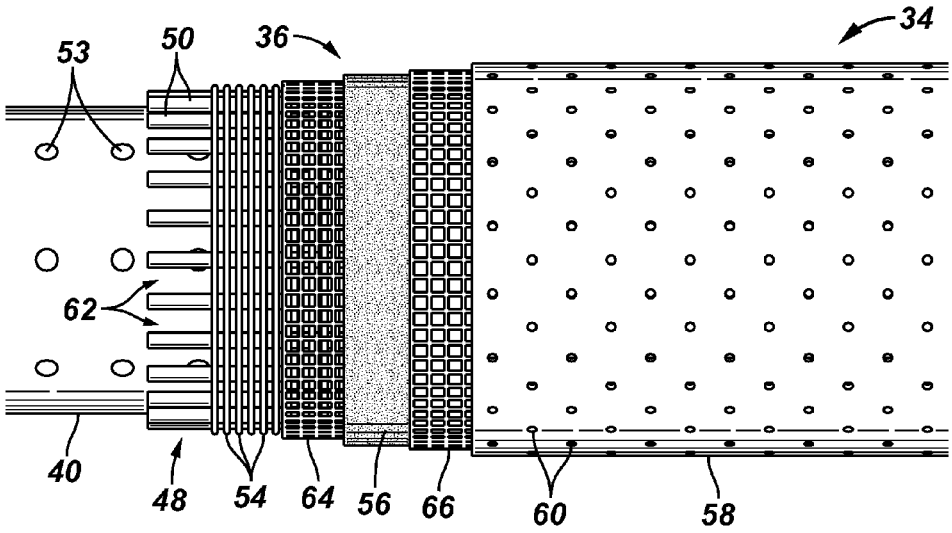
FIG. 4 is a partial view of another example of a sand control screen illustrating various layers of the sand control screen, according to an embodiment of the present invention.

In FIG. 4, an alternate embodiment of sand control screen 36 is illustrated. In this embodiment, a standoff layer 64 is positioned between transversely wrapped wire 54 and filter media 56. The standoff layer 64 may be formed as a mesh layer with pore openings significantly larger than the pore openings of filter media 56. Layer 64 provides extra standoff between layers and support to filter media 56. Additionally, or in the alternative, another standoff layer 66 may be positioned between layers of sand control screen 36. For example, the second standoff layer 66 may be located between filter media 56 and protective shroud 58. Similar to standoff layer 64, layer 66 may be formed as a mesh layer with pore openings significantly larger than the pore openings of filter media 56. Layer 66 also provides extra standoff between layers to facilitate flow of fluid in an axial direction between layers of the screen, e.g. between filter media 56 and protective shroud 58.

Figure 5:
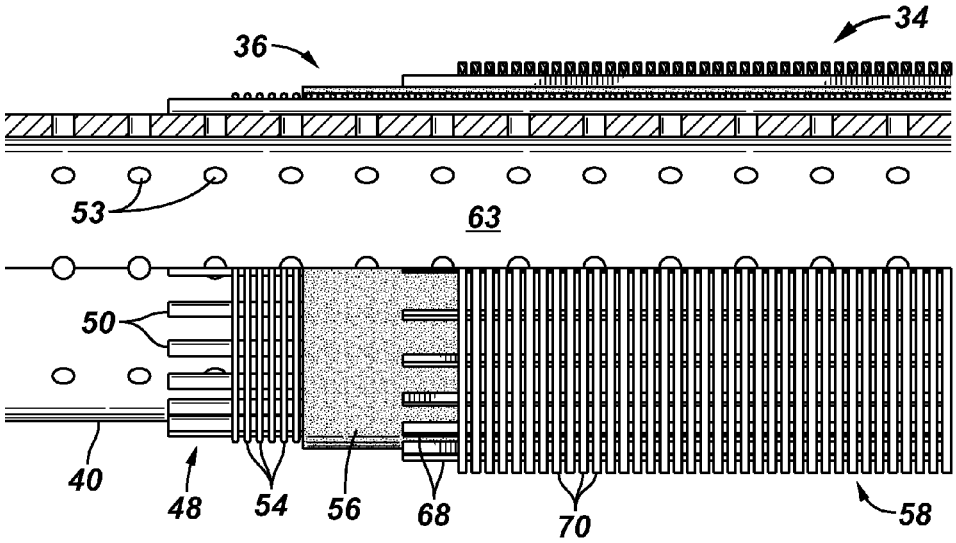
FIG. 5 is a partially broken away view of another example of the sand control screen, according to an embodiment of the present invention.
Figure 6:
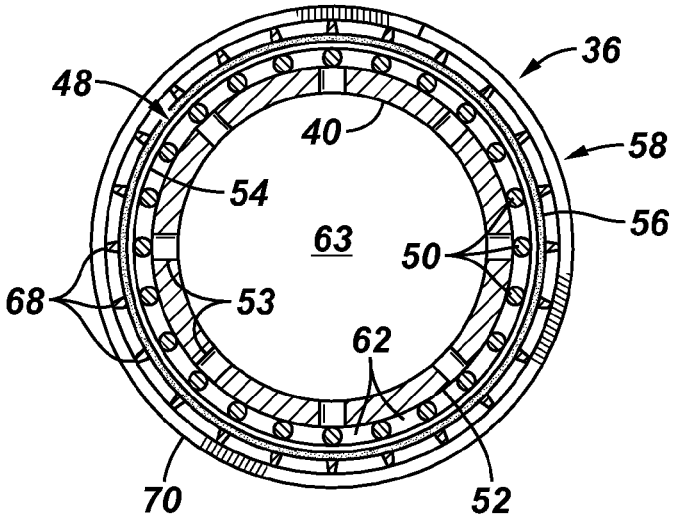
FIG. 6 is a cross-sectional view of the type of sand control screen illustrated in FIG. 5, according to an embodiment of the present invention.

In FIGS. 5 and 6, another embodiment of sand control screen 36 is illustrated as positioned over perforated base pipe 40. In this embodiment, protective shroud 58 is formed with a series of generally axial/longitudinal ribs 68 which are oriented in a generally axial direction along an exterior surface of filter media 56. The plurality of axial ribs 68 is bound together by a transversely wrapped wire 70, e.g. a helically wrapped wire, around the axial ribs 68.

The alternate protective shroud 58 may be constructed in a manner similar to support layer 48 by laying axial ribs 68 directly onto the outside surface of filter media 56. Wire 70 is then wrapped around the axial ribs 68 in a transverse direction to secure the axial ribs 68, as illustrated in FIG. 6. Alternatively, the outer, protective shroud 58 may be manufactured as a jacket which provides a radial gap along the filter media 56 to allow the protective shroud 58 to be slid over the filter media outside diameter. If the protective shroud 58 is slid over the filter media 56, post-assembly processing may sometimes be employed to reduce the diameter of the protective shroud 58 and to reduce or eliminate gaps between the layers of screen 36. Also, the spacing between axial ribs 68 and between wraps of wire 70 is greater than the pore size of filter media 56 to ensure that filtration takes place in the filter media 56 rather than along the outer surface of protective shroud 58.

Depending on the objectives of the downhole flow control, the various fluid flow control assembly components may be made in a variety of configurations. For example, the outer, protective shroud 58 may comprise a wire wrapped shroud, a direct wrap shroud, or a perforated metal shroud having holes of a variety of shapes and designs, e.g. round or louvered. Additionally, the wires 54, 70 and ribs 50, 68 may have a variety of sizes and cross-sectional shapes. As illustrated in the cross-sectional view of FIG. 6, the ribs 50, 68 may have circular cross-sectional shapes, triangular cross-sectional shapes, delta cross-sectional shapes, or other suitable cross-sectional shapes.

Figure 7:
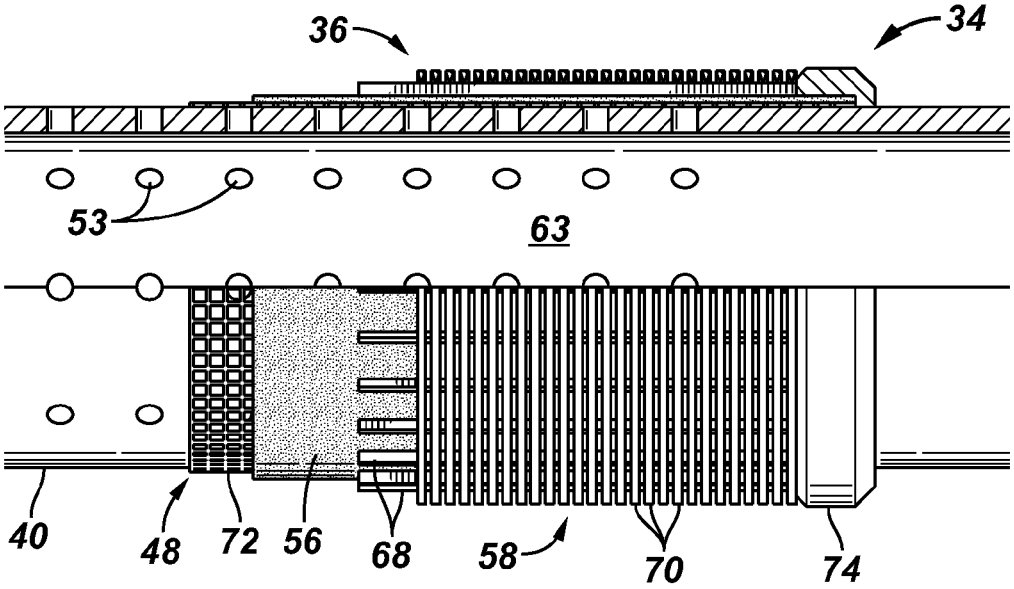
FIG. 7 is a partially broken away view of another example of the sand control screen, according to an embodiment of the present invention.

Referring generally to FIG. 7, another alternate embodiment of sand control screen 36 is illustrated. In this embodiment, the drainage/support layer 48 does not comprise longitudinal ribs 50 but instead comprises a layer of skeletal mesh 72. In some applications, the skeletal mesh layer 72 may be substituted to lower manufacturing costs. In the example illustrated, the protective shroud 58 is again formed of axial ribs 68 held in place by shroud wire 70 which gives the protective shroud 58 and the overall sand control screen 36 substantial strength. In this embodiment, as with other embodiments described herein, one or more of the additional standoff layers 64, 66 may be employed between layers of the sand control screen 36.

Figure 8:
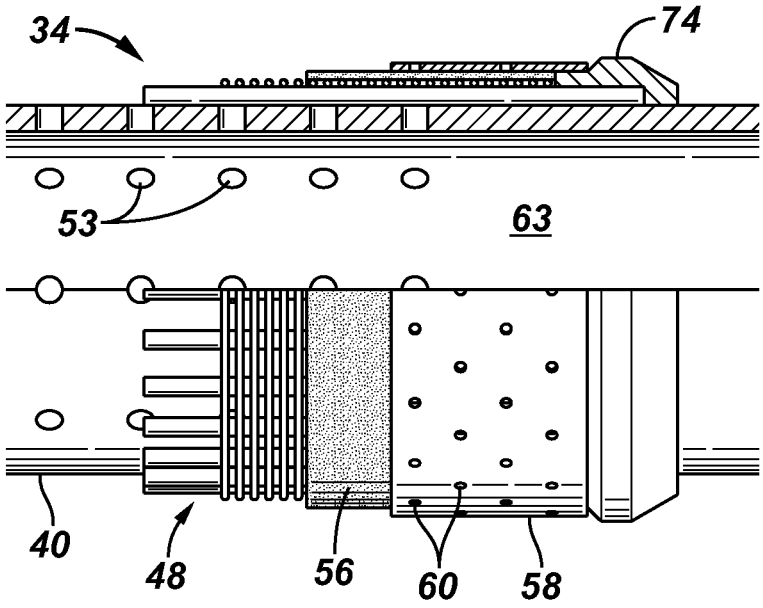
FIG. 8 is a partial cross-sectional view of one example of an axial end of the sand control screen, according to an embodiment of the present invention.

In any of the embodiments described above, layers of the sand control screen 36 may be joined at their axial ends by end rings 74, as further illustrated in FIG. 8. For example, the filter media 56 and outer protective shroud 58 may be joined to the inner drainage/support layer 48 by the end rings 74. In one example, the longitudinal ribs 50 of layer 48 may be secured, e.g. welded, to the end rings 74 at opposite axial ends. Some or all of the other sand control screen layers also may be directly coupled to the end rings 74. The end rings 74 may be used to terminate annular flow paths established by the various sand control screen layers along the outside diameter of base pipe 40. In some embodiments, the end rings 74 may be welded to base pipe 40. However, the design of sand control screen 36 enables attachment to the base pipe without welding in a variety of applications. For example, the drainage/support layer 48 may be designed such that an interference fit, e.g. friction fit, is established between longitudinal ribs 50 and an outer surface of base pipe 40. The friction securely holds the sand control screen 36 in place along the inner base pipe 40.

The overall well system 20 may be designed to accommodate a variety of flow filtering applications in a variety of well environments. Accordingly, the number, type and configuration of components and systems within the overall system may be adjusted to accommodate different applications. For example, the size, number and configuration of the sand control screens can vary. Additionally, the sand control screen may be attached to the base pipe by a variety of attachment techniques to enable placement of the sand control assembly without the need for welding between the sand control screen and the internal base pipe. The wires employed to secure longitudinal/axial ribs in position may be wrapped helically or in other transverse patterns. Also, the types and arrangements of other downhole equipment used in conjunction with the one or more sand control assemblies may be selected according to the specific well related application in which the sand control system and technique are to be utilized.

Although only a few embodiments of the present invention have been described in detail above, those of ordinary skill in the art will readily appreciate that many modifications are possible without materially departing from the teachings of this invention. Accordingly, such modifications are intended to be included within the scope of this invention as defined in the claims.

What is claimed is:

1. A system for removing sand from inflowing fluid in a wellbore, comprising:
- a base pipe having perforations; and
- a sand control screen positioned around the base pipe, the sand control screen comprising:
  - a plurality of longitudinal ribs laid directly against an outer surface of the base pipe, the longitudinal ribs creating a plurality of flow channels oriented to enable generally axial flow along an exterior of the base pipe;
  - a wire transversely wrapped over the plurality of longitudinal ribs to hold the longitudinal ribs securely in place with respect to the base pipe;
  - a filter media surrounding the wire;
  - a standoff layer positioned between the wire and the filter media; and
  - a protective shroud surrounding the filter media.

2. The system as recited in claim 1, wherein the standoff layer comprises a mesh layer positioned between the wire and the filter media.

3. The system as recited in claim 2, wherein the sand control screen further comprises a mesh layer positioned between the filter media and the protective shroud.

4. The system as recited in claim 1, wherein the sand control screen further comprises a mesh layer positioned between the filter media and the protective shroud.

5. The system as recited in claim 1, wherein the filter media comprises a woven layer which is tubular in shape.

6. The system as recited in claim 1, wherein the sand control screen further comprises a pair of end rings to which the plurality of longitudinal ribs, the filter media, and the protective shroud are secured.

7. The system as recited in claim 6, wherein the plurality of longitudinal ribs frictionally engage the base pipe to avoid welding of the sand control screen to the base pipe.

8. The system as recited in claim 1, wherein the spacing between adjacent longitudinal ribs of the plurality of longitudinal ribs is greater than the pore size of the filter media.

9. The system as recited in claim 1, wherein the protective shroud comprises a plurality of axial ribs held together in a tubular shape by a shroud wire wrapped transversely over the plurality of axial ribs.

10. The system as recited in claim 9, wherein the spacing between adjacent axial ribs of the plurality of axial ribs is greater than the pore size of the filter media.

11. A method of removing sand from inflowing fluid in a wellbore, comprising:
- transversely wrapping a wire around a plurality of longitudinal ribs to hold the plurality of longitudinal ribs directly against an outer surface of a base pipe;
- surrounding the wire with a filter media;
- laying longitudinal shroud ribs along an outside surface of the filter media to form a protective shroud around the filter media;
- wrapping a shroud wire around the longitudinal shroud ribs to secure the longitudinal shroud ribs; and positioning a standoff layer between the filter media and the protective shroud.

12. The method as recited in claim 11, further comprising positioning a standoff layer between the wire and the filter media.

13. The method as recited in claim 11, further comprising positioning a mesh layer between the wire and the filter media and between the filter media and the protective shroud.

14. The method as recited in claim 11, further comprising securing the plurality of longitudinal ribs to a pair of end rings.

15. The method as recited in claim 11, further comprising forming a friction fit between the plurality of longitudinal ribs and the base pipe to avoid any welding to the base pipe.

16. The method as recited in claim 11, further comprising forming the base pipe as a perforated base pipe beneath the plurality of longitudinal ribs.

17. The method as recited in claim 16, further comprising welding axial ends of the plurality of longitudinal ribs to adjacent end rings.

18. A system for removing sand from inflowing fluid in a wellbore, comprising:

a base pipe; and a sand control screen, comprising:

a drainage layer disposed around the base pipe;

a filter media surrounding the drainage layer;

a standoff layer between the drainage layer and the filter media; and a protective shroud surrounding the filter media, the protective shroud comprising a plurality of axial ribs disposed along the exterior of the filter media and held together in a tubular shape by a shroud wire wrapped transversely over the plurality of axial ribs.

19. The system as recited in claim 18, wherein the drainage layer comprises a plurality of longitudinal ribs held directly against an outer surface of the base pipe by a transversely wrapped wire.

20. The system as recited in claim 18, further comprising another standoff layer between the filter media and the protective shroud.

* * * * *